United States Patent [19]

Gross et al.

[11] 4,066,122

[45] Jan. 3, 1978

[54] MULTI-LAYER RADIATOR OF PLASTIC MATERIAL AND PROCESS FOR ITS MANUFACTURE

[75] Inventors: Erwin Gross, Burgsolms; Hans Vowinkel, Florsheim am Main, both of Germany

[73] Assignee: Hoechst Aktiengesellschaft, Frankfurt am Main, Germany

[21] Appl. No.: 587,863

[22] Filed: June 18, 1975

[30] Foreign Application Priority Data

June 20, 1974 Germany ..... 2429611

[51] Int. Cl.[2] ..... F28F 9/02

[52] U.S. Cl. ..... 165/175; 65/DIG. 8; 29/157.3 R

[58] Field of Search ..... 165/DIG. 8, 130, 175, 165/171; 29/157.3 R, 157.4

[56] References Cited

U.S. PATENT DOCUMENTS

| | | | |
|---|---|---|---|
| 3,392,779 | 7/1968 | Tilbrook | 165/175 |
| 3,396,785 | 8/1968 | Kirsch | 165/175 |
| 3,669,185 | 6/1972 | Bare | 165/175 X |
| 3,750,744 | 8/1973 | Bowas | 165/175 X |
| 3,841,938 | 10/1974 | Grosse Holling et al. | 165/178 X |

FOREIGN PATENT DOCUMENTS

| | | | |
|---|---|---|---|
| 1,235,697 | 6/1971 | United Kingdom | 123/DIG. 8 |

*Primary Examiner*—Ronald H. Lazarus
*Assistant Examiner*—Ira S. Lazarus
*Attorney, Agent, or Firm*—Curtis, Morris & Safford

[57] ABSTRACT

Multi-layer radiator of plastic material consisting of planar elements comprising an array of vertical water pipes horizontal collecting channels, wherein the planar elements are first connected by straps fastened in the readily accessible border zones of the elements to form units which are then welded together at their end-faces. The radiator can be produced with a few operating steps and the manufacturing costs are considerably reduced.

8 Claims, 7 Drawing Figures

MULTI-LAYER RADIATOR OF PLASTIC MATERIAL AND PROCESS FOR ITS MANUFACTURE

Figure 1:
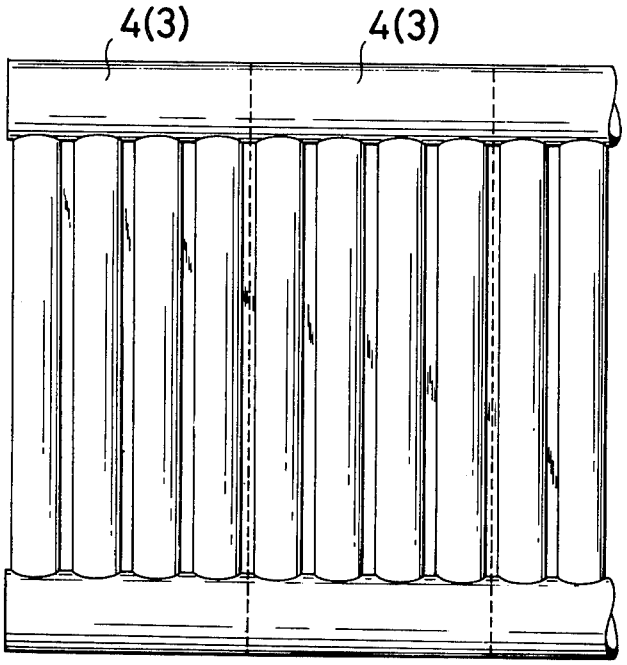

The present invention relates to a multi-layer radiator of plastic material and to a process for its manufacture.

It is known to enlarge the heat exchange surface of radiators by assembling several layers of planar radiator elements consisting of horizontal collecting channels and vertical water pipes. To this effect the individual planar radiator elements are mounted in parallel position with respect to each other and connected by straps. In the case of steel radiators of relatively long flat elements can be assembled into a stable unit by inserting and welding on only a few straps.

With radiators of plastic material the known process for assembling several planar radiator elements can also be used but, owing to the lesser strength of the material, a much larger number of connecting straps is required, which must be fastened to the individual elements, for example by extruded bead welding. This process is rather expensive and uneconomical, the more so as the straps are preferably fastened on parts which are not visible and, hence, difficultly accessible. A possible automatic welding procedure requires a considerable expenditure.

In contradistinction to planar element radiators of stainless steel, corresponding radiators of plastic material are not manufactured by a single process. In the case of plastic material short individual elements are produced, for example by the blowing process, which elements are arranged longitudinally in series and welded at their end surfaces. For the manufacture of the aforesaid multi-layer planar radiators first the individual elements must be assembled to form planar arrays and then several planar arrays must be assembled into a unit by welding connecting straps between the individual arrays. Hence, quite a number of operations is required, which are all rather expensive.

The present invention provides a multi-layer radiator of plastic material, especially of polypropylene, and a process for the manufacture of a radiator of this type each layer of which consist of a plurality of individual elements welded to one another endwise. By the process of the invention the radiator production is considerably simplified, the manufacturing costs are reduced and above all many fewer individual operations are required.

The process for the manufacture of a multi-layer radiator of plastic material according to the invention comprises first connecting a plurality of individual elements by straps to obtain units composed of several layers and then welding the units to one another endwise. The improvement in the radiator according to the invention resides in the fact that it is no longer necessary to weld a great number of connecting straps at difficultly accessible points between relatively large arrays of elements. The individual elements can be assembled in simple manner in parallel position and connected by straps in the readily accessible border portions thereof.

The straps can be fastened on the individual elements by welding, riveting or simply by clamping. Welding of the straps can be combined with the end surface welding of the individual elements. To this effect it is only necessary to adapt the geometry of the heating element used for the butt welding to the shape of the end-faces of the individual elements and of the straps to be welded together.

For the manufacture of a radiator composed of three layers two adjacent units each composed of three parallel individual elements and the necessary connecting straps can be welded together by a single welding operation. Hitherto three welding operations were required for assembling the individual elements and eight welds were needed to fasten the upper and lower connecting straps, whereby the latter had to be made by hand.

Figure 2:
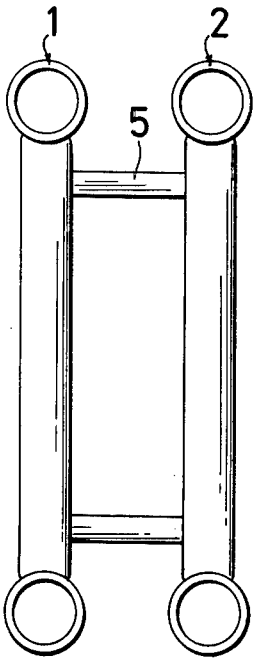
Figure 3:
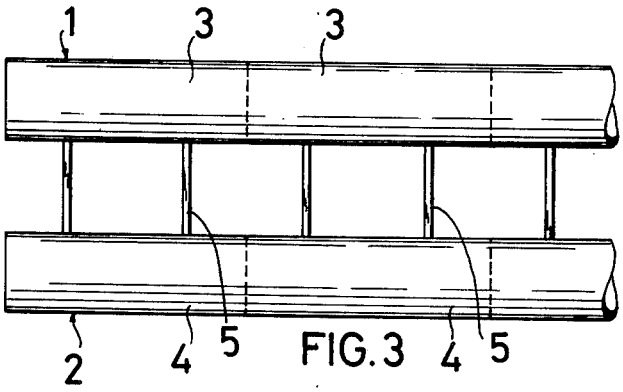

The multi-layer radiator according to the invention will now be described in further detail by way of example with reference to the accompanying drawing in which FIG. 1 is a front view of a radiator FIG. 2 is a side view of a radiator composed of two layers FIG. 3 is a top view of a radiator composed of two layers and FIGS. 4 to 7 are horizontal sections taken through units connected by different types of straps.

In the drawing the multi-radiator is composed of individual planar arrays of tubes 1, 2 in parallel arrangement, each planar array comprising a plurality of individual elements 3, 4 arranged endwise in longitudinal direction. The welding seam between the individual elements 3, 4 is represented by a dotted line.

In the manufacturing process the individual elements 3, 4 are first produced in conventional manner and then they are placed parallel to one another and connected by straps 5 to form units.

Figure 4:
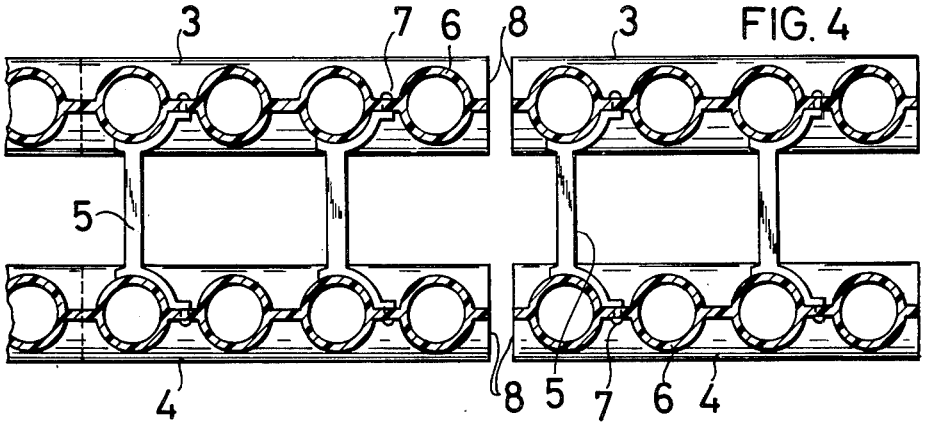

In FIG. 4 the shape of the end portions of the straps 5 is in exact conformity with the shape of the outer wall of the opposite vertical pipes 6 of two individual elements. The individual elements and the straps are joined by passing rivets through the compressed seam 7 between two adjacent water pipes and the strap ends using a hot die or by ultrasonics. The end surfaces 8 of two units consisting of the front surfaces of the collecting channels and the compressed seams of the outermost water pipes are then heated by the heating element of a welding apparatus and welded together.

Figure 5:
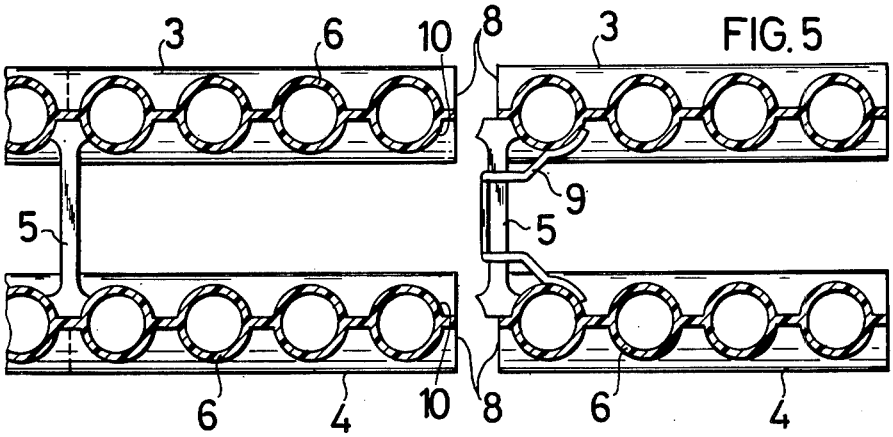

According to the embodiment of FIG. 5 the individual elements are joined to one another by straps 5 which are positioned at the end surfaces 8 of the units and clamped by clamps 9. In this case the heating element for welding has a shape such that simultaneously the end surface 8 of the unit and the area of contact 10 of the straps 5 on the vertical water pipes 6 is heated. By pressing together two units the end surfaces of the individual elements 3, 4 are welded to one another and simultaneously the area of contact 10 of the straps 5 is welded to the wall of the vertical water pipe 6 of the adjacent unit. Thereafter the clamps 9 may be removed.

Figure 6:
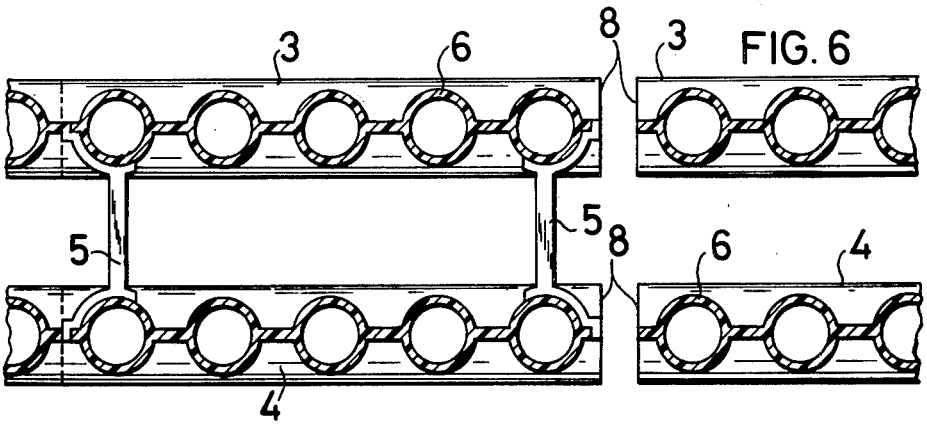

A similar assembly method is shown in FIG. 6. In this case the end portions of the straps 5 embrace a portion of the vertical water pipes 6 and project into clearances in between the outer compressed pipe seams. They are welded at the same time as the end surfaces of the collecting channels. The special advantage of this mode of welding resides in the fact that a flat heating element can be used to weld together two adjacent radiator units inclusive of the straps 5. In the previous mounting the straps are only loosely inserted.

Figure 7:
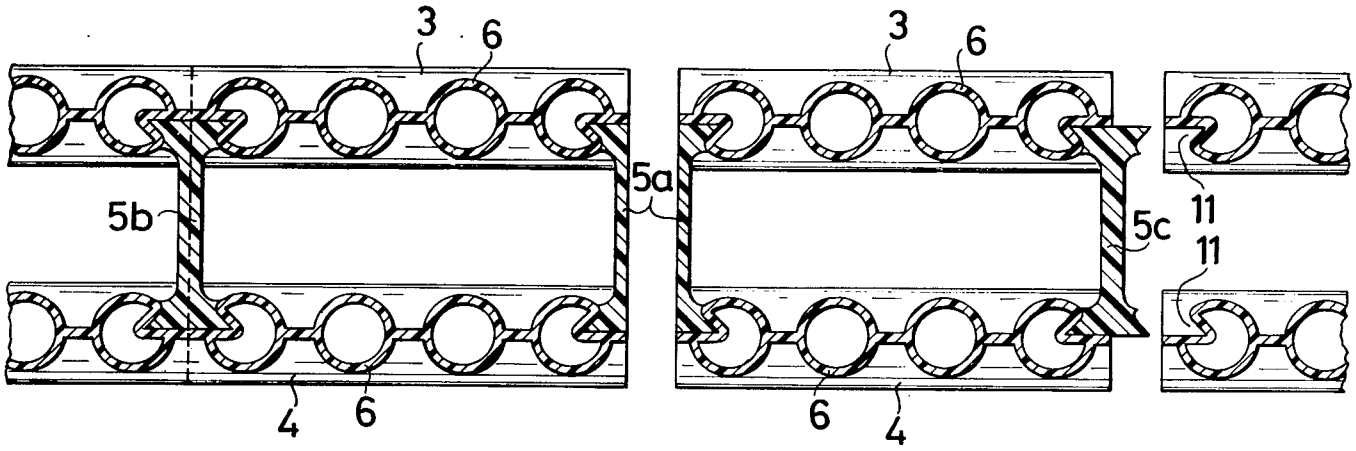

FIG. 7 shows a further embodiment according to which the outermost pipes of the individual elements 3, 4 are provided with recesses 11, into which recesses the connecting straps 5 are clamped. The units thus obtained are then welded together. The connecting strap can be composed of two equal halves 5*a*. In this case it is not separately welded but held in the finished radiator when the end surfaces are welded together. It is likewise possible to weld together the halves of the strap when the end surfaces are welded as at 5*b*. A further variant is shown by 5*c*, where the strap is first inserted in one unit and pushed into the recess of the adjacent unit upon welding of the end surfaces of the two adjacent units.

What is claimed is:

1. A multi-layer radiator of plastic material consisting essentially of planar elements formed of vertical substantially parallel water pipes and a pair of spaced horizontal headers to which the ends of said pipes are connected, said elements being connected to one another by straps at points spaced from said headers to form multi-layer units, the units being firmly joined to one another endwise.

2. A multi-layer radiator of plastic material consisting essentially of planar elements formed of vertical substantially parallel water pipes interconnected by webs of plastic material substantially co-extensive with said pipes and a pair of spaced horizontal headers to which the ends of said pipes are connected, said elements being connected to one another by straps at points spaced from said headers to form multi-layer units, the units being firmly joined to one another endwise.

3. A process for the manufacture of a multi-layer radiator which comprises forming a plurality of elements each comprising a pair of spaced collecting channels connected to the ends of a series of parallel water pipes, said pipes being laterally connected by webs of plastic substantially co-extensive therewith, assembling said elements in parallel into units by securing the outermost pipes in one element to corresponding outermost pipes of another element by straps at points spaced from said collecting channels and assembling said units into said multi-layer radiator by welding the end surfaces of adjacent units to one another, the straps being secured to the pipes by welding at the same time that the surfaces of adjacent units are welded together.

4. A process for making a multi-layer radiator of plastic material wherein each layer consists essentially of individual planar elements formed of vertical substantially parallel water pipes and a pair of spaced horizontal headers to which the ends of said pipes are connected, which comprises connecting said individual elements to one another by straps at points spaced from said headers to form multi-layer units and welding the units thus obtained to one another.

5. The process of claim 3, wherein the straps are fastened to the elements in the readily accessibly end portions of the individual elements by welding.

6. The process of claim 3, wherein the straps are fastened on the individual elements by means of clamps, the ends of the straps are in contact with the walls of vertical pipes of adjacent elements, and the strap ends are welded to the pipe walls simultaneously with the welding of the end surfaces of the multi-layer units.

7. The process of claim 3, wherein the straps are inserted into recesses in the walls of the outermost vertical water pipes of adjacent units.

8. The process of claim 7, wherein the portions of the straps protruding into the recesses in the vertical water pipes are welded simultaneously with the welding of the end surfaces of adjacent units.

* * * * *

UNITED STATES PATENT OFFICE

CERTIFICATE OF CORRECTION

Patent No. 4,066,122 Dated January 3, 1978

Inventor(s) Erwin Gross et al.

It is certified that error appears in the above-identified patent and that said Letters Patent are hereby corrected as shown below:

The following drawing is hereby substituted for the drawing appearing on the first page of the patent:

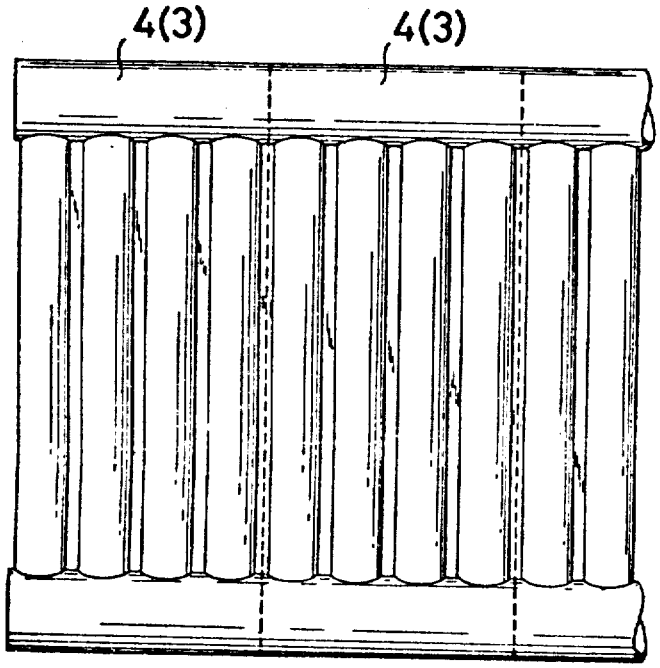

Signed and Sealed this

Twenty-third Day of May 1978

[SEAL]

Attest:

RUTH C. MASON
Attesting Officer

LUTRELLE F. PARKER
Acting Commissioner of Patents and Trademarks